US009321161B2

(12) United States Patent
Ceney

(10) Patent No.: US 9,321,161 B2
(45) Date of Patent: Apr. 26, 2016

(54) TENSIONING APPARATUS

(71) Applicant: FASTENERS SOLUTIONS LIMITED, Willenhall, West Midlands (GB)

(72) Inventor: Stan Ceney, Wolverhampton (GB)

(73) Assignee: TENSCON LIMITED, Wolverhampton (GB)

( * ) Notice: Subject to any disclaimer, the term of this patent is extended or adjusted under 35 U.S.C. 154(b) by 0 days.

(21) Appl. No.: 14/366,867

(22) PCT Filed: Dec. 18, 2012

(86) PCT No.: PCT/GB2012/053167
§ 371 (c)(1),
(2) Date: Jun. 19, 2014

(87) PCT Pub. No.: WO2013/093443
PCT Pub. Date: Jun. 27, 2013

(65) Prior Publication Data

US 2014/0338501 A1 Nov. 20, 2014

(30) Foreign Application Priority Data

Dec. 20, 2011 (GB) ..... 1121976.3

(51) Int. Cl.
*B25B 29/02* (2006.01)
*B25B 13/06* (2006.01)
(Continued)

(52) U.S. Cl.
CPC ..... *B25B 29/02* (2013.01); *B25B 13/06* (2013.01); *B25B 13/481* (2013.01); *B25B 23/0035* (2013.01); *B25B 21/004* (2013.01); *B25B 21/005* (2013.01)

(58) Field of Classification Search
CPC ..... B25B 29/02; B25B 21/005; B25B 21/004
USPC ..... 81/57.38, 57.39, 57.4
See application file for complete search history.

(56) References Cited

U.S. PATENT DOCUMENTS 2,279,681 A * 4/1942 Ilbery ..... 411/323
4,010,669 A * 3/1977 Kloren ..... 411/544
(Continued)

FOREIGN PATENT DOCUMENTS

DE 22 38 974 A1 2/1974
DE 20 2008 012922 U1 3/2010

OTHER PUBLICATIONS

International Search Report for PCT/GB2012/053167, dated Mar. 11, 2013.

*Primary Examiner* — Hadi Shakeri
*Assistant Examiner* — Danny Hong
(74) *Attorney, Agent, or Firm* — Pearne & Gordon LLP

(57) ABSTRACT

The present invention provides an apparatus and kit for tensioning a stud in a bolted joint to a desired preload, the apparatus comprising a locking means adapted for engagement with the stud, a removable bridge member arranged to at least partially enclose the locking means and to receive the stud therethrough, a removable actuator operable to actuate the locking means through the bridge member and removable tensioning means configured to apply tension to a load bearing surface of the bridge member so as to transfer tension to the stud, such that the actuator is operable to lock the locking means when the desired preload in the stud is achieved. The invention has application in many industries, including hydropower, wind, gas and steam turbines, nuclear, metal manufacturing, mining, shipbuilding and oil & petrochemical.

11 Claims, 3 Drawing Sheets

Figure 1:
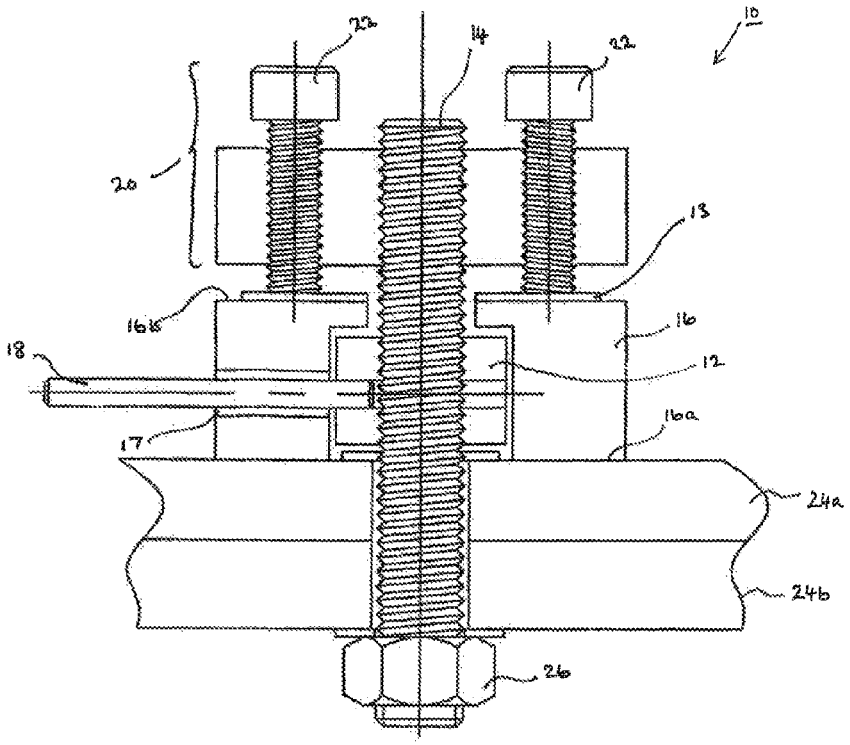

(51) Int. Cl.

| | |
|---|---|
| ***B25B 13/48*** | (2006.01) |
| ***B25B 23/00*** | (2006.01) |
| *B25B 21/00* | (2006.01) |

(56) References Cited

U.S. PATENT DOCUMENTS

| | | | | | |
|---|---|---|---|---|---|
| 4,391,431 | A | | 7/1983 | Maximov | |
| 4,438,901 | A | * | 3/1984 | Reneau et al. | 254/29 A |
| 4,569,506 | A | * | 2/1986 | Vassalotti | 254/29 A |
| 4,708,036 | A | * | 11/1987 | Vossbrinck | 81/57.38 |
| 4,844,418 | A | * | 7/1989 | Cole | 254/29 A |
| 4,846,444 | A | * | 7/1989 | Vassalotti | 254/29 A |
| 5,075,950 | A | | 12/1991 | Steinbock | |
| 5,871,205 | A | * | 2/1999 | Latham | 254/29 A |
| 8,360,094 | B2 | * | 1/2013 | Steinbock et al. | 137/454.6 |

* cited by examiner

TENSIONING APPARATUS

This application is a National Stage application of PCT international application PCT/GB2012/053167, filed on Dec. 18, 2012, which claims the priority of Great Britain Application No. 1121976.3, entitled "A TENSIONING APPARATUS", filed Dec. 20, 2011, both of which are incorporated herein by reference in their entirety.

The present invention relates to a tensioning apparatus and particularly an apparatus and a kit for tensioning studs and bolts in bolted joints.

It is commonly known that if bolted joints are not correctly tensioned or secured together with the correct compressive force or load, then those joints are likely to eventually fail or otherwise experience some form of mechanical fatigue. Accordingly, there are therefore numerous mechanical problems that may potentially result if a bolted joint is not correctly tensioned.

Many bolted joints are fastened together by way of a stud, bolt, threaded rod or shaft having two conventional nuts at either end, which are then tightened together to attain a desired preload tension in the joint. However, one of the major problems associated with traditional stud tightening techniques is as the diameter of the stud increases, the amount of torque required to tighten it increases exponentially as the third power of the diameter. Consequently, the largest size stud or bolt that may typically be tightened by hand is around 3 cm.

To address this problem, the prior art provides several ways of tensioning studs or bolts without requiring excessive amounts of torque to tighten the stud or bolt. One popular device is what is known as a 'multi-jackbolt tensioner', which is a direct replacement for conventional nuts. The device can be simply threaded onto a new or existing stud, bolt, rod or shaft and works by using multiple jackbolts or cap screws that are threaded through the body of the nut or bolt head. Tensioning of the bolted joint is accomplished by applying torque to each of the jackbolts, which are small enough to be tightened by simple hand tools. The jackbolts press against a hardened washer, which transfers the preload evenly into the stud or bolt, and consequently, onto the bolted joint.

In this way, collective loads of up to around 100 MN and greater may be achieved by using only hand tools, such as a torque wrench or a pneumatic tool. Therefore, it is evident that the use of multi-jackbolt tensioners provides many benefits over other tightening techniques, not least in that the bolted joint is tightened in pure tension (i.e. no torsional strain), with only simple tools being required for tightening; while they can also be installed in confined spaces (as they are a direct replacement for a nut) without significant downtime.

However, although multi-jackbolt tensioners are reliable and safe devices for compressing a bolted joint to a desired load, they do have the drawback that they are costly components (due to having multiple parts and requiring accurate machining during fabrication) with one tensioner being permanently required for each stud or bolt to be tensioned. Therefore, if a mechanical structure comprises a large number of bolted joints, the cost to tighten each of these may be prohibitive as a tensioner cannot be reused for subsequent studs or bolts without removing it from the bolted joint.

Hence, it is an object of the present invention to address some, if not all, of the above problems in the art, by providing a reusable tensioning apparatus and kit for tensioning multiple bolted joints without the need to have a permanent tensioner for each joint.

According to a first aspect of the present invention there is a provided an apparatus for tensioning a stud in a bolted joint to a desired preload, the apparatus comprising:

- a locking means adapted for engagement with the stud;
- a removable bridge member arranged to at least partially enclose the locking means and to receive the stud therethrough;
- a removable actuator operable to actuate the locking means through the bridge member; and
- removable tensioning means configured to apply tension to a load bearing surface of the bridge member so as to transfer tension to the stud;
- wherein the actuator is operable to lock the locking means when the desired preload in the stud is achieved.

The provision of a tensioning apparatus comprising at least some components that are removable after a desired preload for a stud is achieved is found to be particularly advantageous, as only a single tensioner (e.g. multi-jackbolt tensioner etc.) is required to tension multiple studs. By contrast, conventional techniques require a permanent tensioner for each and every stud, which must remain in place even after the stud is tensioned to the desired preload.

Therefore, the present invention allows reuse of the same tensioner, which avoids the costs of having to acquire multiple tensioners.

It is to be appreciated that the use of the term "stud" herein is intended to cover all kinds of studs, bolts, threaded rods and shafts, and indeed the apparatus of the present invention may be used with all kinds of fastening devices that are typically used to compress bolted joints to a required tension and where a tensioner of a multi-jackbolt type, for instance, is conventionally used to apply tension to the joint.

By "bolted joint" we mean any mechanical joint, coupling or connection between two or more components or mechanical assemblies that may be fastened or compressed together without limitation.

In particularly preferred embodiments, the locking means may be a threaded nut. The nut is preferably threaded so as to reciprocally engage the threading of the stud. In this way, the locking means may then be simply screwed onto the stud.

The nut may have a circular or hexagonal cross-section. However, any suitable cross-section may be used.

Preferably, in exemplary embodiments, the nut has a circular cross-section and comprises at least one radial bore hole through the body of the nut, and most preferably, comprises a plurality of radial bore holes. By "radial bore hole" we mean a preferably circular channel through the body of the nut, such that the channel has an axis that is approximately orthogonal to the longitudinal axis of the nut. The bore hole may extend fully through the body of the nut (i.e. open at both ends) or else extend only partially through the body (i.e. closed at one end the end closest to the interior surface of the nut).

The function of the bore holes is to receive the removable actuator, in that the actuator may be releasably engaged with the bore hole to enable the nut to be turned (i.e. screwed) on the stud so that the nut can be tightened. In this way, the locking means may be locked when a desired preload is achieved in the stud, as will be discussed in more detail below.

In preferred embodiments, the removable bridge member is substantially cylindrical (e.g. tubular) in form and preferably comprises an open end and a closed end. The circumferential 'lip' of the open end preferably acts as a 'surface' for engaging the planar surface of the bolted joint to be tensioned; while the closed end preferably includes an open bore (e.g. circular aperture) for receiving the stud. In other words, the bridge member may be placed over the stud so that the stud passes through and along the longitudinal axis of the bridge member.

When the bridge member is placed over the stud, it then at least partially encloses (or covers) the locking means. In preferred embodiments, the bridge member comprises at least one aperture or window through which the actuator may pass to releasably engage with the locking means. The aperture is preferably located in a side wall of the bridge member and will typically take the form of a cut-out or cut-away portion of the bridge member. Indeed, in particularly preferred embodiments, the aperture may be a substantially 'U-shaped' cut-out having an 'open edge' that extends to the circumferential lip of the open end of the bridge member.

However, it is to be appreciated that any shape or form of aperture may be used, provided it allows the actuator access to the locking means. Moreover, two or more apertures may be used to enable greater access to the locking means depending on the particular application and implementation of the present apparatus.

In particularly preferred embodiments, the removable actuator comprises an elongate rod adapted to engage with at least one of the radial bore holes. The elongate rod is preferably fabricated from hardened steel and is most preferably a conventional "tommy bar". The actuator may therefore be inserted through the aperture of the bridge member to engage with a bore hole, enabling the locking means (e.g. nut) to be turned. The actuator may then be removed and (re-)inserted into the next bore hole which has been rotated into the aperture. In this way, the nut may be turned and tightened by repeated application of the tommy bar to the nut.

The use of a tommy bar and circular nut is especially advantageous, as it allows the nut and bridge member to be respectively sized so that only a small internal (circumferential) gap exists between them. As a result, the 'foot print' (i.e. diameter) of the bridge member can be kept relatively small, which allows the present apparatus to be used in confined spaces or difficult to install locations. By contrast, if the nut were a conventional hexagonal nut, with the actuator being a wrench or spanner, the spacing between the nut and the bridge member would need to be considerably larger to enable the wrench to engage with the nut through the aperture. Although such an arrangement is not excluded by the present invention, this is not preferred. But it is possible that such an arrangement could be used in some applications and/or implementations.

The removable tensioning means preferably comprises a jacking nut or a multi-jackbolt tensioner consisting of a plurality of jackbolts or cap screws. Indeed, in exemplary embodiments, the tensioner is ideally a nut-type multi-jackbolt tensioner having a pitch circle diameter of cap screws as known in the prior art.

The use of a multi-jackbolt tensioner is beneficial as it allows the many advantages of this type of tensioner to be utilised in the present application. Therefore, the stud may be tensioned to relatively large preload tensions by the application of only a relatively low torque to each of the cap screws. As a result, only simple hand tools or pneumatic devices need be used to load the bolted joint to the required tension. Moreover, as multi-jackbolt tensioners tighten the stud in pure tension there is no torsional strain.

The apparatus may further comprise a washer removably disposed between the tensioning means and the bridge member, such that the washer abuts the closed end of the bridge member. The washer is preferably made from hardened steel and serves to prevent damage to the closed end surface of the bridge member when the cap screws are tightened in the tensioner.

In use, the present apparatus tensions the stud to a desired preload by applying torque to each of the cap screws. The bridge member preferably sits atop the bolted joint and covers the locking means which have been engaged with the stud (e.g. the nut has been threaded onto the stud) and tightened against the surface of the bolted joint. The hardened washer preferably sits between the bridge member and the tensioning means (e.g. multi-jackbolt tensioner), which is also threaded onto the stud and rests against the washer on top of the bridge member.

When the stud is placed under load, it is found that it elastically extends or stretches according to Hooke's Law within its elastic limit (i.e. it undergoes elastic deformation along its length). The desired preload in the stud can be divided between the number of cap screws in the tensioner, as the individual loads on the cap screws combine to form the total load on the stud. By knowing the individual load required for each cap screw, a torque setting may be derived from established tables of load values, whereupon a simple hand tool (e.g. torque wrench) may be used to apply the required torque to each of the cap screws.

To ensure reliable tensioning of the bolted joint, the cap screws are preferably tightened in a careful sequence which avoids any non-symmetric loading of the cap screws. Therefore, a 'star' sequence for tightening the cap screws is preferably adopted, in that the caps screws are tightened in an order that preferably resembles the points on a star image, for example, diametrically opposite cap screws are tightened one after another so that symmetric loading of the jointed is achieved.

After initial loading, it is found that since the stud has extended, the nut no longer abuts against the surface of the bolted joint. Indeed, in practice an air gap actually forms between the nut and the surface of the bolted joint, as a result of the tension in the stud. The actuator may then be re-inserted into the nut to preferably further tighten the nut to eliminate the air gap and enable the nut to bed down against the surface of the bolted joint. Additional tightening of the cap screws may then be performed, with the above procedure being repeated as often as necessary until the desired preload is achieved in the stud.

Once the preload is attained, the cap screws may then be relaxed as the tension in the stud (due to the action of the locking means) maintains compression or loading of the bolted joint. The tensioner, bridge member and actuator may then all be removed from the bolted joint, leaving the locking means in place to keep the joint together.

As a result, the removable components may then be advantageously re-used to tighten a further bolted joint, without the need for another tensioner. The only component that is not re-used is the locking means, but this is not as elaborate (or as expensive) to replace as another tensioner. Of course, the locking means may be subsequently re-used if it no longer becomes necessary to maintain the bolted joint under compression.

The use of the locking means not only saves costs but also permits easy maintenance of the bolted joint, as if it becomes necessary to release the compression of the joint only one component need be relaxed (i.e. un-tightened), as opposed to the multiple cap screws of conventional tensioners—which are themselves very quick to release. Hence, the present invention provides significant advantages over the prior art and can minimise downtime for maintenance and repair etc.

According to a second aspect of the present invention there is a provided a tensioning kit for use with a tensioner of a type such as a multi-jackbolt tensioner, the kit comprising:

a locking means for engaging a stud in a bolted joint;

a bridge member arranged to at least partially enclose the locking means and to receive the stud therethrough, the bridge member being operable to transfer tension to the stud under the action of the tensioner; and an actuator operable to actuate the locking means through the bridge member and to lock the locking means when a desired preload in the stud is achieved.

The kit is most preferably used with a conventional nut-style multi-jackbolt tensioner of the sort having a plurality of individual jackbolts or cap screws. However, as will be appreciated any suitable tensioner may be used with the kit of the present invention.

It is to be appreciated that none of the aspects or embodiments described in relation to the present invention are mutually exclusive, and therefore the features and functionality of one aspect and/or embodiment may be used interchangeably or additionally with the features and functionality of any other embodiment without limitation.

Figure 2:
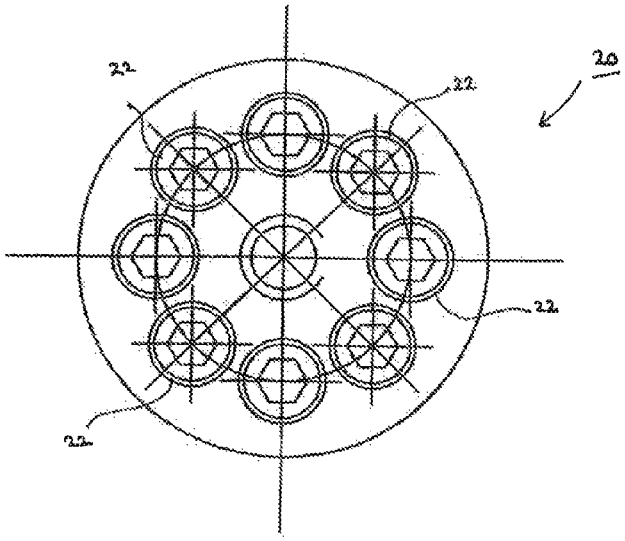
Figure 3:
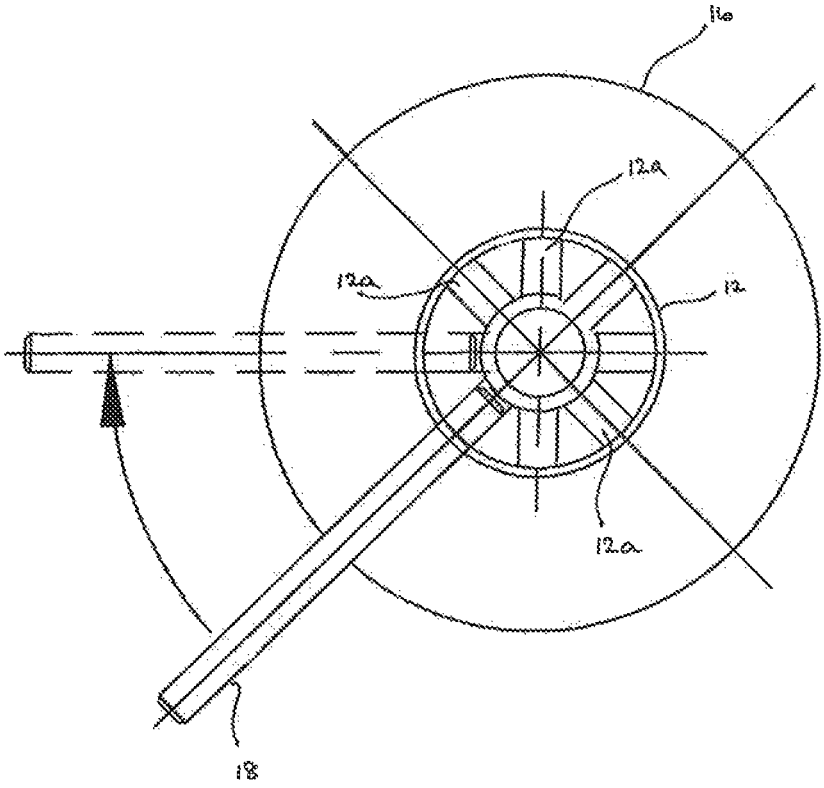
Figure 4:
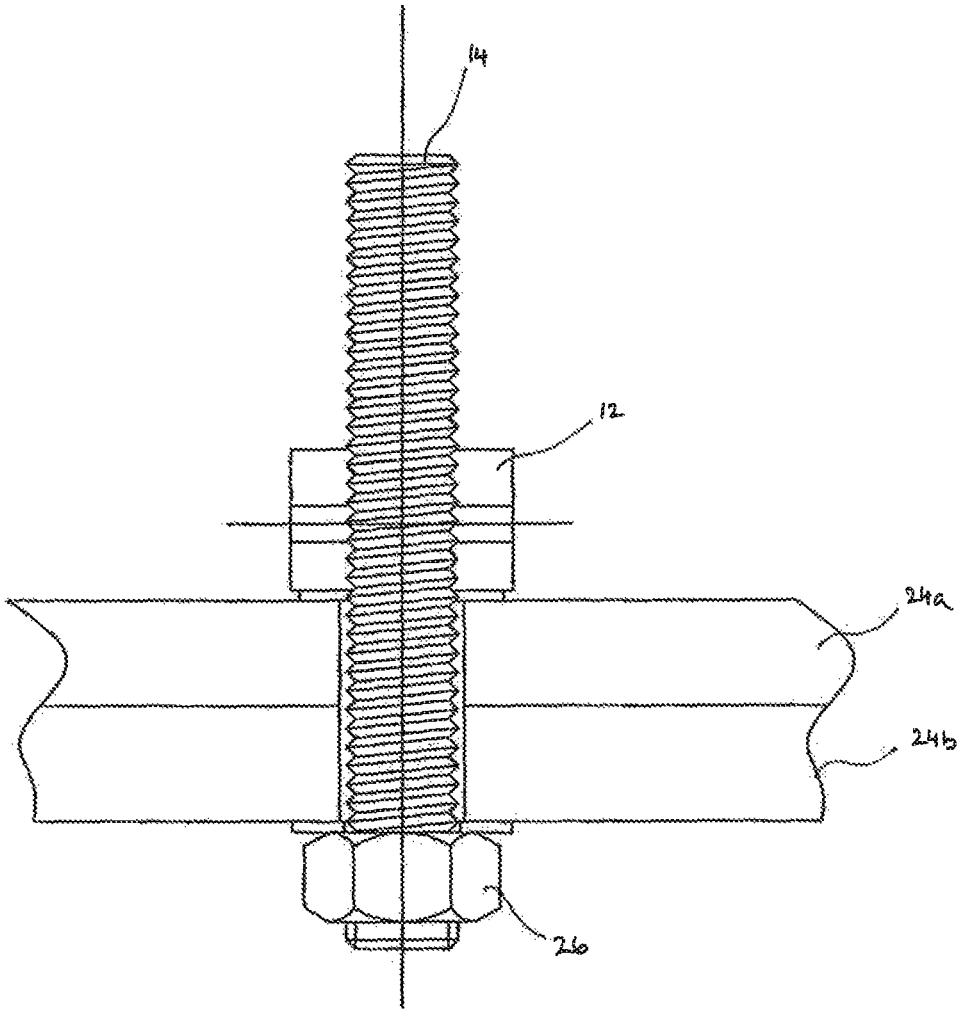

Embodiments of the present invention will now be described in detail by way of example and with reference to the accompanying drawings in which:

FIG. 1—shows a side cross-sectional view of a tensioning apparatus according to a particularly preferred embodiment of the present invention;

FIG. 2—shows a plan view of an example tensioner as used in the embodiment of FIG. 1;

FIG. 3—shows a top cross-sectional view of part of the apparatus of FIG. 1;

FIG. 4—shows a side cross-sectional view of the non-removable parts of the tensioning apparatus of FIG. 1 after the stud has been tensioned to the desired preload;

Referring to FIG. 1, there is a shown a particularly preferred embodiment of a tensioning apparatus 10 according to the present invention. It is to be understood that the apparatus as shown in FIG. 1 is not drawn to scale and therefore the figure is intended for illustrative purposes only, but this could represent any example bolted joint.

The tensioning apparatus 10 comprises a locking means 12 adapted for engagement with a stud 14, a removable bridge member 16 arranged to enclose or cover the locking means 12 and a removable actuator 18 operable to actuate the locking means 12 through the bridge member 16.

In addition, the tensioning apparatus 10 also comprises a removable tensioning means 20, which in this example is a nut-type multi-jackbolt tensioner having a pitch circle diameter of cap screws 22 (although only two cap screws are shown in cross-section in FIG. 1).

As shown in FIG. 1, the tensioning apparatus 10 is deployed in use against an example bolted joint having respective abutting flanges 24 *a* and 24 *b*. The stud 14 passes through the flanges 24 *a*, 24 *b* and terminates in a conventional nut 26. The bolted joint could be any mechanical joint, coupling or mechanical assembly that is intended to be compressed to a desired load or tension.

It is to be appreciated, however, that although FIG. 1 shows a stud 14 and nut 26, this could alternatively be any form of mechanical fastener, such as a bolt, headed fastener or cap screw etc.

In the example shown, the locking means 12 is a threaded nut, which reciprocally engages the threading of the stud 14. In this way, the nut 12 may be simply screwed onto the stud 14 until it engages the surface of flange 24*a*.

The nut 12 has a circular cross-section and comprises a plurality of radial bore holes 12*a* through the body of the nut (as best shown in FIG. 3). Any number of bore holes may be used, but in the example discussed herein the nut 12 has eight bore holes 12*a*.

Each bore hole 12 defines a circular channel through the body of the nut 12, such that the channel has an axis that is approximately orthogonal to the longitudinal axis of the nut. Each bore hole 12*a* extends fully through the body of the nut (as shown in FIGS. 1 & 3), but could alternatively extend only partially through the body (i.e. closed at one end—the end closest to the interior surface of the nut).

The function of the bore holes 12*a* is to receive the removable actuator 18, in that the actuator 18 may be releasably engaged with a bore hole 12*a* (as shown in FIGS. 1 & 3) to enable the nut 12 to be turned (i.e. screwed) on the stud 14 so that the nut can be tightened. In this way, the nut 12 may be locked (i.e. fully tightened) when a desired preload is achieved in the stud 14, as will be discussed in more detail below.

The removable bridge member 16 is cylindrical (e.g. tubular) in form and comprises an open end 16*a* and a closed end 16*b*. The circumferential 'lip' of the open end 16*a* acts as a 'surface' for engaging the surface of the flange 24*a*; while the closed end 16*b* includes an open bore (e.g. circular aperture) for receiving the stud 14 (as shown in FIG. 1). In other words, the bridge member 16 is placed over the stud 14 so that the stud passes through and along the longitudinal axis of the bridge member.

Referring to FIG. 1, when the bridge member 16 is placed over the stud 14, it covers the nut 12. However, the bridge member 16 comprises an aperture or window 17 through which the actuator 18 can pass to releasably engage with the nut 12. The aperture 17 is located in the side wall of the bridge member 16 and takes the form of a cut-out portion of the bridge member.

In the example shown, the actuator 18 is in the form of an elongate rod, such as a "tommy bar", fabricated from hardened steel. The tommy bar 18 may therefore be inserted through the aperture 17 of the bridge member 16 to engage with a bore hole 12*a* (as shown in FIGS. 1 and 3), enabling the nut 12 to be turned. The tommy bar 18 may then be removed and (re-)inserted into the next bore hole 12*a* which has been rotated into the aperture 17. In this way, the nut 12 may be turned and tightened by repeated application of the tommy bar 18 to the nut.

Referring again to FIG. 1, the tensioning apparatus 10 further comprises a washer 13 removably disposed between the multi-jackbolt tensioner 20 and the bridge member 16, such that the washer 13 abuts the closed end 16*b* of the bridge member. The washer 13 is made from hardened steel and serves to prevent damage to the closed end surface of the bridge member 16 when the cap screws 22 are tightened in the tensioner 20.

The use of a multi-jackbolt tensioner 20 is beneficial as it allows the many advantages of this type of tensioner to be utilised in the present application. Therefore, the stud 14 may be tensioned to relatively large preload tensions by the application of only a relatively low torque to each of the cap screws 22. As a result, only simple hand tools or pneumatic devices need be used to load the bolted joint to the required tension. This improves safety for the installers, while also benefitting the environment as no heavy machinery (e.g. bulky and/or high pressure hydraulic or electrical compressors) are required saving power and expense.

Moreover, as multi-jackbolt tensioners tighten the stud in pure tension there is no torsional strain, which eliminates the possibility of thread galling, as commonly occurs with direct torquing methods.

An example operation of the tensioning apparatus 10 will now be discussed with reference to FIGS. 1 to 3. In use, the apparatus 10 tensions the stud 14 to a desired preload by applying torque to each of the cap screws 22. The bridge member 16 sits atop flange 24*a* of the bolted joint and covers the nut 12, which is threaded onto the stud 14 and tightened against the surface of the flange 24*a*. The hardened washer 13 sits between the bridge member 16 and the multi-jackbolt tensioner 20, which is also threaded onto the stud 14 and rests against the washer 13 on top of the bridge member 16. When the stud 14 is placed under load, it is found that it elastically extends or stretches according to Hooke's Law within its elastic limit (i.e. it undergoes elastic deformation along its length). The desired preload in the stud 14 can be divided between the number of cap screws 22 in the tensioner 20, as the individual loads on the cap screws 22 combine to form the total load on the stud 14. By knowing the individual load required for each cap screw 22, a torque setting may be derived from established tables of load values, whereupon a simple hand tool (e.g. torque wrench) may be used to apply the required torque to each of the cap screws 22.

In the example of FIG. 2, the cap screws 22 are simple hex nuts, which may be tightened with an Allen key or similar tool.

To ensure reliable tensioning of the bolted joint, the cap screws 22 are tightened in a careful sequence which avoids any non-symmetric loading of the cap screws. Therefore, a 'star' or 'swan' sequence for tightening the cap screws is preferably adopted, in that the caps screws are tightened in an order that preferably resembles the points on a star image, for example, diametrically opposite cap screws are tightened one after another so that symmetric loading of the jointed is achieved (cf. FIG. 2).

After initial loading, it is found that since the stud 14 has extended, the nut 12 no longer abuts against the surface of the flange 24*a*. Indeed, in practice an air gap actually forms between the nut 12 and the flange 24*a*, as a result of the tension in the stud 14. The tommy bar 18 may then be re-inserted into the nut 12 to further tighten the nut to eliminate the air gap and enable the nut to bed down against the surface of the flange 24*a*. Additional tightening of the cap screws 22 may then be performed, with the above procedure being repeated as often as necessary until the desired preload is achieved in the stud 14.

Once the preload is attained, the cap screws 22 may then be relaxed as the tension in the stud 14 (due to its inherent elastic restoring force) maintains compression or loading of the bolted joint—as it essentially pulls the nut 12 towards nut 26. As shown in FIG. 4, the tensioner 20, bridge member 16 and tommy bar 18 may then all be removed from the bolted joint, leaving the nut 12 in place to keep the flanges 24*a* and 24*b* together.

All components of the present apparatus and kit are manufactured from high strength steel for safety and longevity of use, and each component may be covered with a protective coating to enhance corrosion and rust resistance. It should also be understood that no special training is required to use the present apparatus and therefore even semi-skilled operators or those with little engineering experience would be able to implement the present invention.

Moreover, the present apparatus may be used in conjunction with load indicating devices, particularly the load indicating washer disclosed in co-pending application no. PCT/GB2012/052114 and as manufactured by Clarkwood Engineering Ltd., UK.

As will be appreciated from the foregoing embodiments, the present invention is able to provide a simple, easy to fit/retro-fit, and cost-effective solution to reliably tension a mechanical joint to a desired preload. Therefore, although the tensioning apparatus and kit are ideally suited for ensuring an accurate and consistent tensioning of studs, bolts, threaded rods and shafts etc., it will be recognised that one or more of the principles of the invention may extend to other tensioning applications due, not least, to the inherent scalability of the apparatus and kit.

The above embodiments are described by way of example only. Many variations are possible without departing from the invention.

The invention claimed is:

1. An apparatus for tensioning a stud in a bolted joint to a desired preload, the apparatus comprising:

a locking means adapted for engagement with the stud;

a removable bridge member arranged to at least partially enclose the locking means and to receive the stud therethrough;

a removable actuator operable to directly engage with and actuate the locking means through the bridge member; and removable tensioning means configured to apply tension to a load bearing surface of the bridge member so as to transfer tension to the stud;

wherein the actuator is operable to tighten the locking means on the stud when the desired preload in the stud is achieved.

2. The apparatus of claim 1, wherein the locking means is a threaded nut.

3. The apparatus of claim 2, wherein the nut comprises at least one radial bore hole through the body of the nut.

4. The apparatus of claim 3, wherein the nut comprises a plurality of radial bore holes.

5. The apparatus of claim 1, wherein the bridge member comprises at least one aperture through which the actuator may releasably engage with the locking means.

6. The apparatus of claim 3, wherein the bridge member comprises at least one aperture through which the actuator may releasably engage with the locking means, and the actuator comprises an elongate rod adapted to engage with at least one of the radial bore holes.

7. The apparatus of claim 1, wherein the tensioning means comprises a jacking nut or a multi-jackbolt tensioner comprising a plurality of jackbolts or cap screws.

8. The apparatus of claim 1, further comprising a washer removably disposed between the tensioning means and the bridge member.

9. The apparatus of claim 1, wherein the bridge member has a second surface for engaging with the bolted joint.

10. The apparatus of claim 1, wherein action of the tensioning means on the bridge member brings about an elastic deformation of the stud along its length.

11. A tensioning kit for use with a tensioner of a type such as a multi-jackbolt tensioner, the kit comprising:

a locking means for engaging a stud in a bolted joint;

a bridge member arranged to at least partially enclose the locking means and to receive the stud therethrough, the bridge member being operable to transfer tension to the stud under action of the tensioner; and an actuator operable to directly engage with and actuate the locking means through the bridge member so as to tighten the locking means on the stud when a desired preload in the stud is achieved.

* * * * *